US010889079B2

(12) United States Patent
Mößnang

(10) Patent No.: US 10,889,079 B2
(45) Date of Patent: Jan. 12, 2021

(54) FORMING TOOL AND METHOD FOR PRODUCING A PACKAGING

(71) Applicant: Multivac Sepp Haggenmüller SE & Co. KG, Wolfertschwenden (DE)

(72) Inventor: Konrad Mößnang, Kempten (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 198 days.

(21) Appl. No.: 16/196,476

(22) Filed: Nov. 20, 2018

(65) Prior Publication Data

US 2019/0160775 A1 May 30, 2019

(30) Foreign Application Priority Data

Nov. 24, 2017 (EP) ..... 17203560

(51) Int. Cl.

| | |
|---|---|
| ***B31B 50/12*** | (2017.01) |
| ***B31B 50/14*** | (2017.01) |
| ***B31B 50/59*** | (2017.01) |
| ***B31B 50/74*** | (2017.01) |
| ***B31B 50/44*** | (2017.01) |
| *B31B 110/35* | (2017.01) |
| *B31B 100/00* | (2017.01) |

(52) U.S. Cl.

CPC ..... *B31B 50/12* (2017.08); *B31B 50/142* (2017.08); *B31B 50/44* (2017.08); *B31B 50/592* (2018.05); *B31B 50/745* (2017.08); *B31B 2100/0024* (2017.08); *B31B 2110/35* (2017.08)

(58) Field of Classification Search

CPC ..... B31B 50/12; B31B 50/142; B31B 50/745; B31B 50/592; B31B 2100/0024; B31B 2110/35

See application file for complete search history.

(56) References Cited

U.S. PATENT DOCUMENTS 3,933,562 A * 1/1976 Cruckshank ..... B29C 51/04 156/250
4,801,347 A * 1/1989 Garwood ..... B29C 49/0047 156/245

(Continued)

FOREIGN PATENT DOCUMENTS

| | | | |
|---|---|---|---|
| DE | 2008313 | A1 | 9/1971 |
| DE | 2226222 | A1 | 12/1972 |
| DE | 102014106427 | A1 | 11/2015 |

*Primary Examiner* — Andrew M Tecco
*Assistant Examiner* — Nicholas E Igbokwe
(74) *Attorney, Agent, or Firm* — Brooks Kushman P.C.

(57) ABSTRACT

A pre-punched material sheet for constructing a packaging trough, the material sheet includes a sub-area that has been punched out incompletely so that the sub-area is connected to a residual area of the material sheet through a plurality of retaining lugs. The material sheet is positioned on top of a female die part of a forming tool and the sub-area at least partially covers an opening of a forming cavity of the female die part. The residual area of the material sheet may be clamped in position against the female die part. The sub-area of the material sheet is sucked onto an insert in the forming cavity using a vacuum. The insert is vertically movable in the forming cavity from a first position to a second position to draw the sheet into the forming cavity and thereby form the packaging trough.

16 Claims, 4 Drawing Sheets

(56) References Cited

U.S. PATENT DOCUMENTS

| | | | | |
|---|---|---|---|---|
| 5,217,563 | A * | 6/1993 | Niebling | B29C 51/10 156/228 |
| 5,253,801 | A * | 10/1993 | Bernstein | B65D 5/20 229/110 |
| 5,418,022 | A * | 5/1995 | Anderson | B29D 22/003 206/439 |
| 2014/0070458 | A1 * | 3/2014 | Preisler | B29C 51/002 264/322 |

* cited by examiner

FORMING TOOL AND METHOD FOR PRODUCING A PACKAGING

CROSS-REFERENCE TO RELATED APPLICATIONS

This Application claims priority to European Patent Application No. 17203560.2 filed on Nov. 24, 2017 to Konrad Mößnang, currently pending, the entire disclosure of which is incorporated herein by reference.

FIELD OF THE INVENTION

The present invention relates to the field of the production of packaging, in particular packaging produced, at least partially, from a material that is essentially not thermoplastically deformable.

BACKGROUND OF THE INVENTION

EP 2 829 392 A1 discloses a device for forming a cardboard blank into a dish-shaped or cup-shaped article. By means of a punching device, individual blanks are fully punched out from a cardboard web. The punched-out individual blanks are then fed to a forming station for the purpose of reshaping. The forming station comprises a female die part and a male die part, which is adapted to be lowered into the latter. A fold retainer is provided, which can be acted upon in the direction of the female die part, so that the individual blank to be reshaped is clamped in position between the female die part and the fold retainer. This intends to guarantee a controlled sliding forward of the material during forming. A counter piston is arranged opposite to the male die part and is capable of pressing against the underside of the individual blank. In this way, the bottom of the part to be formed is intended to be held during forming. This system is disadvantageous insofar as the material to be processed must be fed to the forming station in the form of individual blanks that have already fully been separated from one another. Hence, an individual blank must be transferred to the forming station for each part to be produced. Moreover, in spite of the fold retainer, at least small folds form during forming. Due to the male die part, which is positioned above the female die part such that it is lowerable into the latter, it is normally not possible to further process the formed parts directly in the forming station for reasons of space.

SUMMARY OF THE INVENTION

It is the object of the present invention to provide a method, which allows to produce packaging from a material that is not thermoplastic or only slightly thermoplastic and which can be integrated efficiently into a superordinate working process. In addition, a suitable forming tool is provided.

In a method for producing a packaging according to an aspect of the present invention, a pre-punched material sheet may be first provided. A sub-area of the material sheet may be punched out incompletely from the pre-punched material sheet such that the sub-area may be connected to a residual area of the material sheet through a plurality of retaining lugs. The incompletely punched-out sub-area is intended to form, later on, the packaging or part of the latter, and may have a corresponding shape. If, for example, the packaging is to be produced as a packaging trough having a rectangular base area, the sub-area may be punched out as a substantially rectangular area. However, other shapes are imaginable as well. The packaging may, for example, be configured as a packaging trough having a round or an elliptical base area.

Preferably, the retaining lugs may be positioned such that the incompletely punched-out sub-area may be held in several directions at the residual area of the material sheet. In this way, the punched-out sub-area may remain in a defined orientation and position relative to the residual area of the material sheet.

The pre-punched material sheet may be positioned on top of a female die part of a forming tool such that the incompletely punched-out sub-area of the material sheet covers an opening of a forming cavity of the female die part at least partially. The forming cavity of the female die part may be configured according to the desired shape of the packaging to be produced.

When the pre-punched material sheet has been positioned on top of the female die part, the residual area of the material sheet may be clamped in position against a contact surface of the female die part. It may be possible, but not absolutely necessary, that the residual area of the material sheet actually comes into contact with the female die part. It would also be imaginable that one or a plurality of intermediate elements may be provided between the contact surface of the female die part and the residual area of the material sheet, provided that the residual area of the material sheet may be, at least sectionwise, immobilized relative to the contact surface by clamping.

The incompletely punched-out sub-area of the material sheet may be sucked by means of a vacuum onto an insert, which may be vertically movable in the forming cavity of the female die part. At this time, the vertically movable insert may be at a starting position. From the starting position, the vertically movable insert may be moved along a displacement direction further into the forming cavity. During this movement, the sucking of the sub-area of the material sheet onto the vertically movable insert may be continued. The sub-area of the material sheet may be thus drawn into the forming cavity and formed into a packaging trough in this way.

As has already been mentioned, a material sheet may be used, from which the sub-area, which will subsequently be used for forming the packaging, has been punched out from the material sheet only incompletely. Hence, the sub-area may be fed to the forming tool together with the residual area of the material sheet. This will facilitate correct positioning on top of the female die part of the forming tool even if the punched-out sub-area should have a complicated shape. In particular, automated positioning on top of the female die part will be facilitated, since the residual area of the material sheet will be available as a surface that can be acted upon by holding or gripping elements.

Within the scope of the present invention, it may be also possible that a plurality of sub-areas are punched out incompletely from the material sheet, these sub-areas being then each formed into a packaging trough in a respective associated forming cavity of the female die part with a suitable vertically movable insert, as described hereinbefore. Through suitable positioning of the material sheet, it may be thus be possible to position, in a single step, the material for a plurality of packaging troughs on top of the female die part and to then form the packaging troughs simultaneously.

Since the sub-area of the material sheet may be, due to the fact that it is suctionally attracted by means of a vacuum, drawn into the forming cavity during the movement of the vertically movable insert, the provision of a male die part, which presses the material into the forming cavity of the female die part, is not necessary (but nevertheless possible). It follows that, in the case of the present invention, the packaging trough formed in the female die part may be more easily accessible from above and may be subjected to further processing steps directly in the female die part. For this purpose, e.g. additional devices may be provided above the female die part.

Preferably, in one embodiment, the retaining lugs will tear when the vertically movable insert is moved from the starting position further into the forming cavity, whereby the sub-area will be separated from the residual area of the material sheet. Since the residual area of the material sheet may be clamped in position against the contact surface of the female die part and the sub-area of the material sheet may be sucked onto the vertically movable insert by means of a vacuum, the retaining lugs may tear in a controlled manner. Twisting of the sub-area or of the material sheet during tearing of the retaining lugs will normally not be possible.

Preferably, the forming cavity of the female die part may comprise a forming incline, which widens in the direction towards the opening. In this way, packaging troughs may be formed, whose sidewalls are inclined outwards in a direction of an opening of the packaging trough. Due to the forming incline, the sub-area of the material sheet can, in addition, more easily be drawn into the forming cavity.

Within the meaning of the present invention, it may be possible that the material sheet provided has already been pre-punched. For example, pre-punched material sheets could have been obtained from a supplier or produced in a separate process in advance. Pre-punched material sheets may be provided as respective separate sheets. However, it would also be imaginable that a plurality of pre-punched material sheets may be provided in an interconnected condition, e.g. in the form of a supply roll. The pre-punched material sheets may then be separated from one another before they are positioned on top of the female die part, or a pre-punched material sheet may be positioned on top of the female die part without having been separated from the other material sheets previously.

It may be also imaginable that the method according to the present invention comprises the step of pre-punching the material sheet. The step of providing the pre-punched material sheet could then comprise the pre-punching of the material sheet, preferably by means of a punching station. The sub-area of the material sheet may here be punched out incompletely from the material sheet, so that the sub-area remains connected to the residual area of the material sheet through the plurality of retaining lugs.

It would be imaginable that the material sheet may be already provided as a separate plate of material prior to pre-punching. This plate of material could be positioned on top of the female die part manually or automatically after the pre-punching step. It would, however, also be imaginable that the material sheet may be part of a longer material web, which may be unwound from a supply roll. In this case, the material sheet could first be fed to a punching station for pre-punching the material sheet and then be positioned on top of the female die part of the forming tool by advancing the material web, so as to position the pre-punched material sheet. In addition, it would be imaginable that the punching station has fed thereto a material web and that the punching station separates the material sheet from the rest of the material web simultaneously with the punching out of the sub-area, or in an additional step.

Preferably, the material of the material sheet may be essentially not thermoplastically deformable. However, it may be imaginable that the material sheet consists of a material that comprises components which, taken on their own, are thermoplastically deformable. If the material of the material sheet is not thermoplastically deformable, tearing of the retaining lugs may take place in a particularly controlled manner. The material of the material sheet may preferably comprises natural fibers, cardboard and/or paper. This allows inexpensive, environmentally friendly and stable packaging to be produced.

According to an advantageous further development, a thermoplastic film layer may be positioned on top of the material sheet on top of the female die part. The thermoplastic film layer can be formed-in into the packaging trough formed from the sub-area of the material sheet, so that, later on, a product to be packed and the packaging trough will not be in direct contact with each other. This will be advantageous especially in the event that the product to be packed comprises moisture, which would be absorbed by the packaging trough on contact. The thermoplastic film layer may be positioned on top of the material sheet while the material sheet may be located on top of the female die part. For example, the thermoplastic film layer may be positioned on top of the material sheet before the sub-area of the material sheet may be drawn into the forming cavity by moving the vertically movable insert, thus forming the packaging trough. In principle, it would, however, also be imaginable that the packaging trough may be formed first and the thermoplastic film layer may be positioned on top of material sheet only subsequently. In both cases, the film layer may, however, be positioned on top of the material sheet as long as the latter still lies on the female die part. Hence, it will not be necessary to transfer the packaging trough into a further work station before the thermoplastic film layer may be applied.

Preferably, the thermoplastic film layer may be formed into the packaging trough by applying compressed air from the side of the film layer facing away from the material sheet. Through the compressed air the thermoplastic film layer may be acted upon in the direction of the interior of the packaging trough and can be brought into fitting contact with the interior of the packaging trough. Preferably, the thermoplastic film layer may be here held by the clamping unit. The thermoplastic film layer may already be acted upon by compressed air while the sub-area of the material sheet may be drawn into the forming cavity for forming the packaging trough, so that the thermoplastic film layer will immediately be brought into shape together with the packaging trough. However, may also be imaginable to completely form the packaging trough first and only then apply compressed air to the thermoplastic film layer so as to form the thermoplastic film layer into the packaging trough.

In order to allow the thermoplastic film layer to be formed more easily, the film layer may be heated, after having been positioned on top of the material sheet on top of the female die part, by means of a heating unit provided on the side of the film layer facing away from the female die part. The heating unit may be movable in particular parallel to the displacement direction of the vertically movable insert. In order to allow positioning of the material sheet and of the thermo-plastic film layer, the heating unit may be moved to a stow-away position in a direction away from the female die part. After the thermoplastic film layer has been positioned, the heating unit may be moved from the stow-away position in the direction of the female die part to a heating position, so as to heat the thermoplastic film layer.

The present invention additionally relates to a forming tool for producing a packaging from a material sheet, which, by incompletely punching out a sub-area of the material sheet, has been pre-punched such that the sub-area may remain connected to a residual area of the material sheet through a plurality of retaining lugs. The forming tool may be adapted, suitable and configured for carrying out the method according to the present invention. Features described with respect to the method may be transferred to the forming tool or to a packaging machine comprising the forming tool, and vice versa.

The forming tool according to the present invention comprises a female die part comprising a forming cavity with an opening and a contact surface. In addition, the forming tool comprises a clamping unit, which is configured for clamping the residual area of the material sheet in position against the contact surface of the female die part, when the pre-punched material sheet has been positioned on top of the female die part such that the sub-area of the material sheet covers the opening of the forming cavity of the female die part at least partially. The forming cavity of the female die part has provided therein a vertically movable insert, which may be movable from a starting position along a displacement direction further into the forming cavity. The forming tool further comprises a vacuum unit, the vacuum unit being adapted to have applied thereto a vacuum, which can be generated, for example, using a vacuum pump, and configured for sucking the sub-area of the material sheet onto the vertically movable insert by means of a vacuum. According to an advantageous embodiment, the vertically movable insert has provided therein channels with openings through which the vacuum unit can suctionally attract the sub-area of the material sheet.

Preferably, the forming cavity of the female die part comprises a forming incline, which widens towards the opening.

The forming tool may further comprise a compressed-air unit configured for acting on a thermo-plastic film layer, which may be positioned on top of the material sheet on top of the female die part, in the direction towards the material sheet by applying compressed air from the side of the film layer facing away from the material sheet.

The forming tool may comprise a heating unit configured for heating the film layer, after the film layer has been positioned on top of the material sheet on top of the female die part, from the side of the film layer facing away from the female die part.

The heating unit may be movable towards the female die part and away from the female die part parallel to the displacement direction of the vertically movable insert.

The present invention additionally relates to a packaging machine comprising the forming tool described. The packaging machine may additionally comprise a punching station configured for pre-punching the material sheet by incompletely punching out the sub-area of the material sheet, so that the sub-area remains connected to the residual area of the material sheet through the plurality of retaining lugs.

The packaging machine may additionally comprise a conveying unit configured for positioning the material sheet, which has been pre-punched by the punching station, on top of the female die part of the forming tool such that the sub-area of the material sheet covers the opening of the forming cavity of the female die part at least partially.

According to a further aspect of the present invention, a method for producing a packaging may be provided, in the case of which, instead of the pre-punched material sheet with the incompletely punched-out sub-area, a separate material blank, which may be formed into a packaging trough, may be positioned on top of the female die part of a forming tool.

This kind of method may comprise the step of positioning a material blank on top of a female die part of a forming tool such that the material blank covers an opening of a forming cavity of the female die part at least partially. The material blank may be sucked by means of a vacuum onto an insert, which may be vertically movable in the forming cavity of the female die part, at a starting position of the vertically movable insert. From the starting position, the vertically movable insert may be moved along a displacement direction further into the forming cavity, whereby the material blank may be drawn into the forming cavity and thus formed into a packaging trough.

Other than in the case of the method in which the pre-punched material sheet with the incompletely punched-out sub-area may be processed, clamping the material in position against a contact surface of the female die part may no longer be necessary with this kind of method. In order to allow nevertheless easy positioning of the material blank at a suitable position on top of the female die part, the material blank may optionally be oriented relative to a positioning element. Such a positioning element, for example, in the form of positioning pins and/or positioning edges, may be provided on or attached to the female die part for example.

Features described with respect to the method in which the pre-punched material sheet with the incompletely punched-out sub-area may be processed may be transferred to the method in which the material blank may be processed. In particular, the features according to claims 4 to 9 may be transferred, alone or in an arbitrary combination, to the method in which the material blank may be processed.

Also the method in which the material blank may be processed can be carried out by the forming tool described. Optionally, the clamping unit of the forming tool may, in this case, be omitted and/or the positioning element described may additionally be provided.

Other aspects and advantages of the present invention will be apparent from the following detailed description of the preferred embodiments and the accompanying drawing figures.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1:
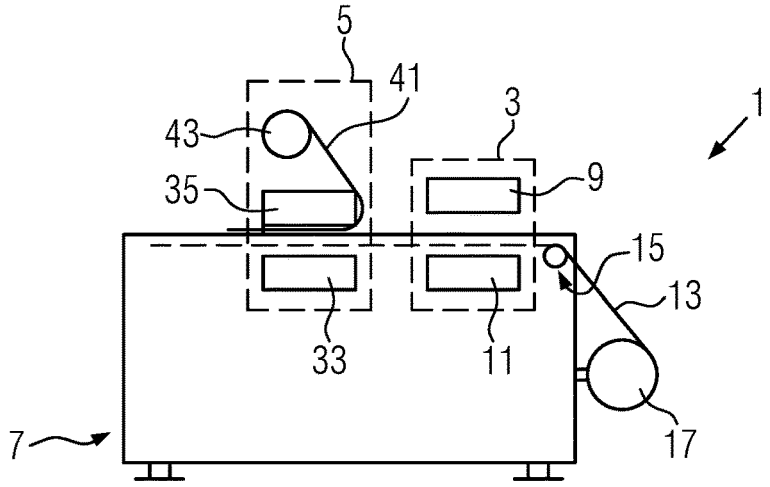
FIG. 1 is a schematic view of one embodiment of a packaging machine comprising a forming tool and a punching station in accordance with the teachings of the present disclosure.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a packaging machine 1 according to an embodiment. The packaging machine 1 comprises a punching station 3 as well as a forming tool 5, both provided on a machine frame 7. The punching station 3 comprises a punching tool upper part 9 and a punching tool lower part 11. By means of a conveying unit 15, a material web 13 is taken from a supply roll 17, which is attached to the machine frame 7, and fed to the punching station 3. The conveying unit 15 may comprise e.g. clamp chains guided on the machine frame 7 on both sides of the material web 13 and used for clampingly holding the material web 13.

Figure 2:
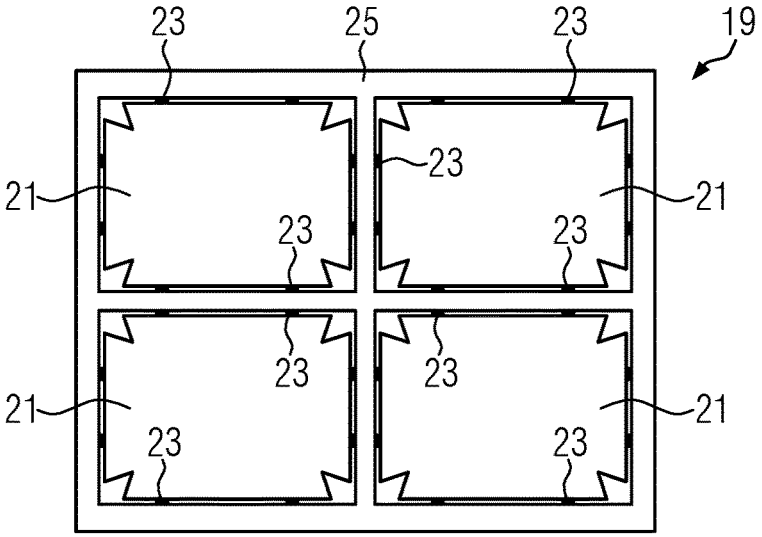
FIG. 2 is a schematic top view of one embodiment of a pre-punched material sheet in accordance with the teachings of the present disclosure.

The punching station 3 is configured for pre-punching the material web 13. In particular, a material sheet 19, which constitutes part of the material web 13, is pre-punched. FIG. 2 shows, in a schematic top view, a material sheet 19 that has been pre-punched by the punching station 3. In the embodiment shown, this material sheet 19 was also separated from the rest of the material web 13 during pre-punching. This, however, is not absolutely necessary. In addition, it would also be imaginable that, instead of the material web 13, material sheets 19 which have already been separated are fed to the punching station 3.

Figure 3:
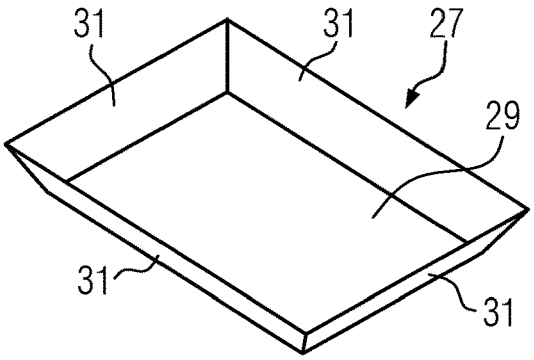
FIG. 3 is a perspective schematic view of one embodiment of a packaging trough produced with a method in accordance with the teachings of the present disclosure.

In the embodiment shown, the punching station 3 punches, during pre-punching of the material sheet 19, four sub-areas 21 out from the material sheet 19 by incomplete punching-out, so that the sub-areas 21 remain connected to a residual area 25 of the material sheet 19 through a plurality of retaining lugs 23. The sub-areas 21 each correspond to a region that will be formed into a packaging trough 27 with the forming tool 5 later on. In the embodiment shown, packaging troughs 27 having the shape shown in FIG. 3 are to be produced, i.e. packaging troughs 27 with a rectangular base area 29 and outwardly tilted sidewalls 31. Of course, also other configurations would be imaginable for the packaging trough 27, such as a packaging trough 27 having an arbitrary polygon, a circle or an ellipse as a base area 29. The configuration of the sub-areas 21 of the material sheet 19 which are to be punched out incompletely may be adapted to the respective desired shape of the packaging trough 27.

In the embodiment shown, four sub-areas 21 are punched out incompletely from each material sheet 19 by the punching station 3, as mentioned above. It follows that four packaging troughs 27 can be produced simultaneously when the material sheet 19 is further processed by the forming tool 5 as described hereinafter. Of course, it would also be imaginable to punch out any other number of sub-areas 21 incompletely from the material sheet 19. In particular, it would also be imaginable to punch out only one sub-area 21 incompletely from a material sheet 19 and to produce each individual packaging trough 27 separately.

After pre-punching, the material sheet 19 is transferred to the forming tool 5 for further processing. In particular, the pre-punched material sheet 19 is positioned on top of a female die part 33 of the forming tool 5. In the embodiment shown, this is done by advancing the material sheet 19 by means of the conveying unit 15. However, it would e.g. also be imaginable to feed the material sheet 19 manually to the forming tool 5.

Figure 4A:
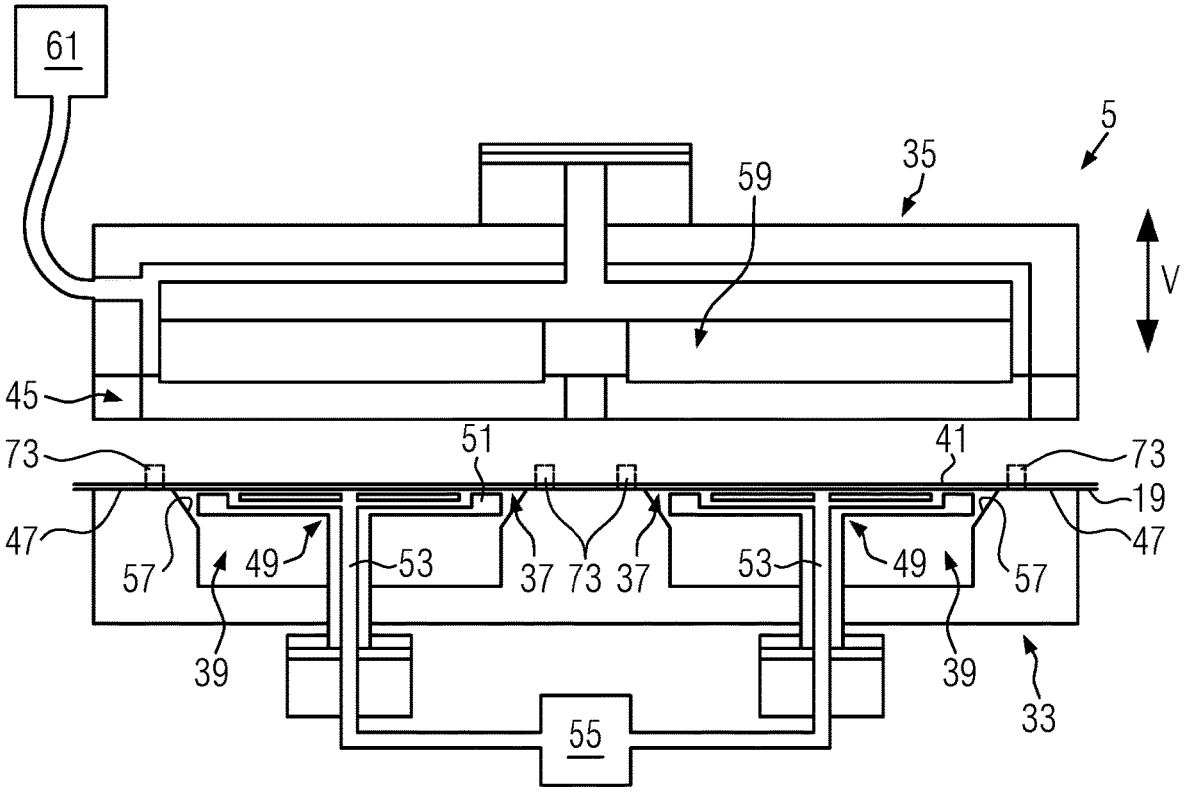
FIG. 4A is a schematic view of one embodiment of a forming tool in accordance with the teachings of the present disclosure showing one sequence of the operating conditions during production of a packaging in accordance the present disclosure.

The forming tool 5 comprises the female die part 33 as well as a cover part 35. FIG. 4A shows the forming station 5, in part, in an open operating condition. In the open operating condition, the female die part 33 and the cover part 35 are spaced apart such that the material sheet 19 can be positioned between the female die part 33 and the cover part 35. In FIG. 4A, the material sheet 19 has already been positioned, by means of the conveying unit 15, on top of the female die part 33 such that each of the incompletely punched-out sub-areas 21 of the material sheet 19 covers a respective opening 37 of an associated forming cavity 39 of the female die part 33. In addition, a thermoplastic film layer 41 has been positioned on top of the material sheet 19 on the material sheet side facing away from the female die part 33. In the embodiment shown, the thermoplastic film layer 41 is unwound from a suitable supply roll 43 of the forming tool 5 (cf. FIG. 1).

Figure 4B:
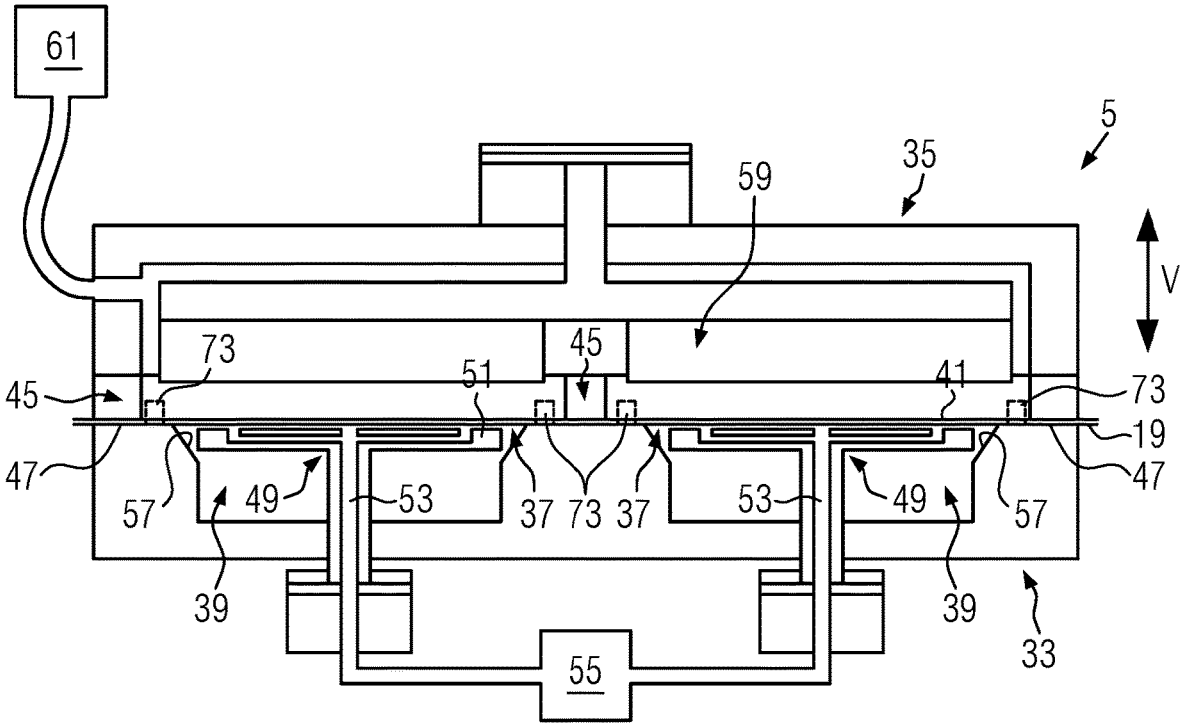
FIG. 4B is a schematic view of the embodiment of a forming tool of FIG. 4A showing another sequence of the operating conditions during production of a packaging in accordance the present disclosure.

After the pre-punched material sheet 19 and the thermoplastic film layer 41 have been positioned between the female die part 33 and the cover part 35 of the forming tool 5, the forming tool 5 is closed by moving the female die part 33 and the cover part 35 towards each other. The resultant operating situation is shown in FIG. 4B. On its end facing the female die part 33, the cover part 35 comprises a clamping unit 45, which, in the embodiment shown, is configured as a grid corresponding substantially to the shape of the residual area 25 of the material sheet 19. In the closed condition of the forming tool 5, the clamping unit 45 clamps the residual area 25 of the material sheet 19 against a contact surface 47 of the female die part 33. Also the thermoplastic film layer 41 provided on top of the material sheet 19 is clamped against the contact surface 47 of the female die part 33 by means of the clamping unit 45 and is thus immobilized. Preferably, an air-tight sealed inner space is defined, in the closed condition of the forming tool 5, by the female die part 33 and the cover part 35 together with the material sheet 19 clamped in position therebetween and the thermoplastic film layer 41 clamped in position therebetween.

The forming tool 5 comprises vertically movable inserts 49, each forming cavity 39 of the female die part 33 having provided therein a respective one of these inserts 49. Each of the inserts 49 is vertically movable along a displacement direction V inside the respective forming cavities 39. The displacement direction V is parallel to the direction along which the female die part 33 and the cover part 35 of the forming tool 5 are moved relative to each other so as to close or open the forming tool 5. In FIG. 4A and 4B, each of the vertically movable inserts 49 is shown at its respective starting position, which corresponds to a maximum extended position. At the starting position, a holding plate 51 of a vertically movable insert 49 is located substantially on a level on which it is flush with the opening 37 of the respective forming cavity 39 of the female die part 33. The vertically movable inserts 49 each comprise channels 53 terminating in openings, which are formed in the holding plate 51 and which face the material sheet 19. The channels 53 communicate with a vacuum unit 55, which is configured for sucking the sub-areas 21 of the material sheet 19 onto the holding plate 51 of the respective vertically movable insert 49 by means of a vacuum applied through the channels 53. After the forming tool 5 has been closed, each of the sub-areas 21 is, at least sectionwise, sucked by means of the vacuum unit 55 onto the respective vertically movable insert 49 and is held on the latter.

Figure 4C:
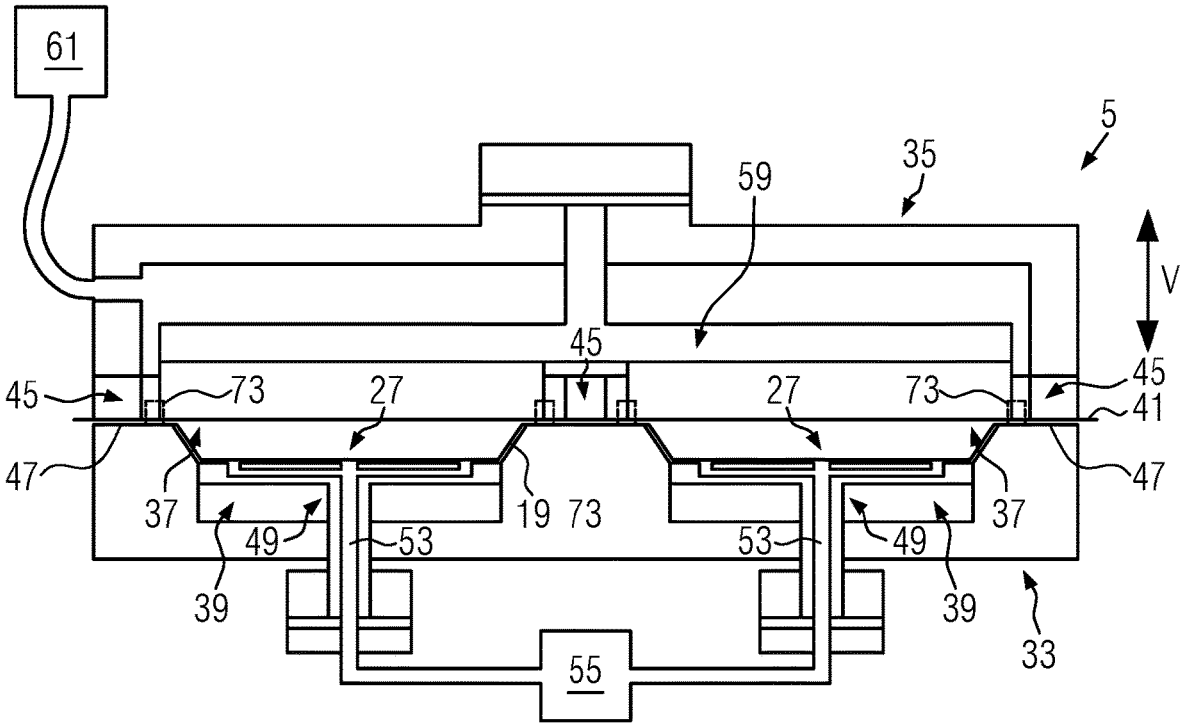
FIG. 4C is a schematic view of the embodiment of a forming tool of FIG. 4A showing another sequence of the operating conditions during production of a packaging in accordance the present disclosure.

After the incompletely punched-out sub-areas 21 have been sucked onto the respective vertically movable insert 49, the vertically movable inserts 49 are moved along the displacement direction V from the starting position further into the forming cavities 39. In the course of this process, the sub-areas 21 of the material sheet 19 are drawn into the forming cavities 39 and are thus each formed into a packaging trough 27. FIG. 4C shows the situation after the vertically movable inserts 49 have been fully moved in. Due to the fact that the incompletely punched-out sub-areas 21 were sucked onto the inserts 49 during moving-in of the inserts 49, the sub-areas 21 were formed into packaging troughs 27 while they were drawn into the respective forming cavity 39 through engagement with sidewalls of the forming cavity 39, in particular with forming inclines 57 of the forming cavities 39, which widen in the direction of the openings 37 of the forming cavities 39. Since the residual area 25 of the material sheet 19 is clamped against the contact surface 47 of the female die part 33 during moving-in of the vertically movable insert 49, the retaining lugs 23 will tear while the sub-areas 21 are drawn into the forming cavities 39 and the packaging troughs 27 will be separated from the residual area 25 of the material sheet 19.

Figure 4D:
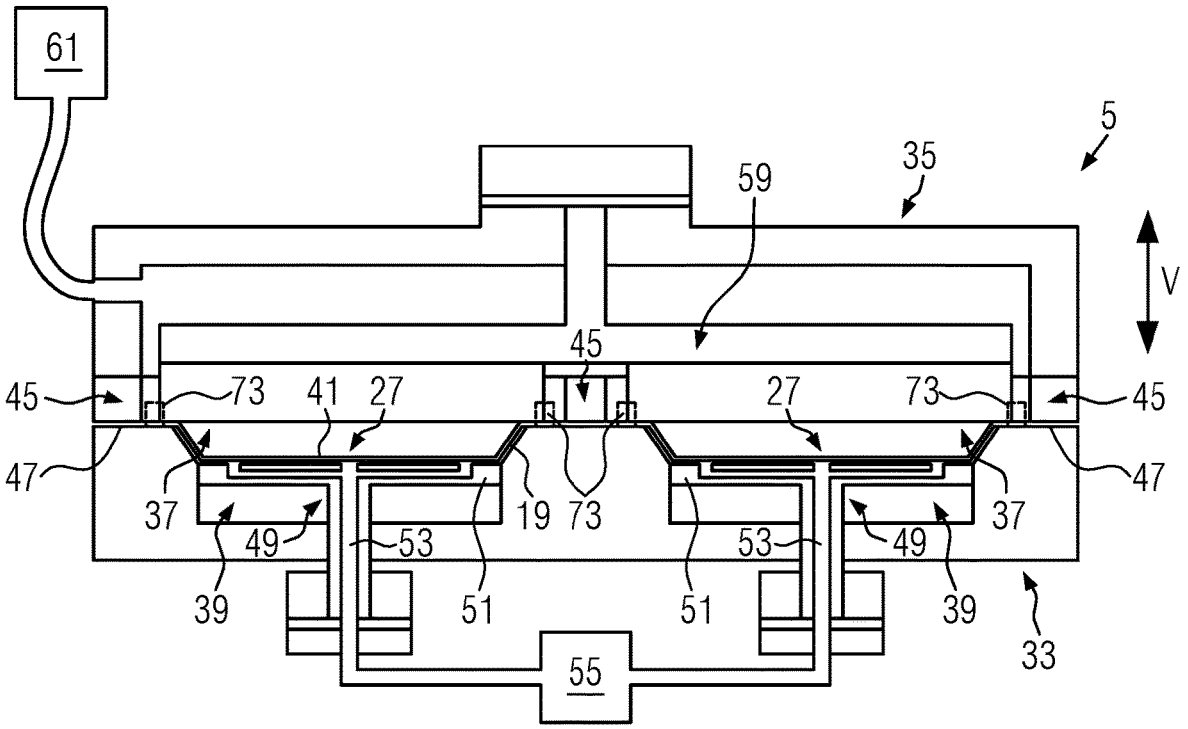
FIG. 4D is a schematic view of the embodiment of a forming tool of FIG. 4A showing another sequence of the operating conditions during production of a packaging in accordance the present disclosure.

The cover part 35 of the forming tool 5 has provided therein a heating unit 59, which is movable towards the female die part 33 and away from the female die part 33 parallel to the displacement direction V of the vertically movable inserts 49. In FIG. 4A and 4B, the heating unit 59 is shown at a stow-away position, at which it has been moved inside the cover part 35 away from the female die part 33 to the maximum possible extent. After the forming tool 5 has been closed, the heating unit 59 is moved from the stow-away position towards the female die part 33 to a heating position, which is shown in FIG. 4C and 4D. As can be seen from FIG. 4C, the heating unit 59, when occupying the heating position, is located adjacent the thermoplastic film layer 41 and will thus be able to heat the latter, so as to improve the deformability of the film layer 41.

After the packaging troughs 27 have been formed by drawing the incompletely punched-out sub-areas 21 into the forming cavities 39, the heated thermoplastic film layer 41 is formed-in into the packaging troughs 27 by applying compressed air from the side of the film layer 41 facing away from the female die part 33. For this purpose, the forming tool 5 may comprise a corn-pressed-air unit 61 that is capable of introducing air into the interior of the cover part 35 of the forming tool 5. Due to the pressure rise inside the cover part 35, the thermoplastic film layer 41 will be formed-in into the packaging troughs 27, as shown in FIG. 4D. In this way, the packaging troughs 27 are provided with an interior film layer. The provision of such a film layer is, however, not absolutely necessary and the thermoplastic film layer 41 may also be omitted completely. Alternatively, the thermoplastic film layer 41 may also be connected to the packaging trough 27 in a separate work station downstream of the forming tool 5.

Figure 5:
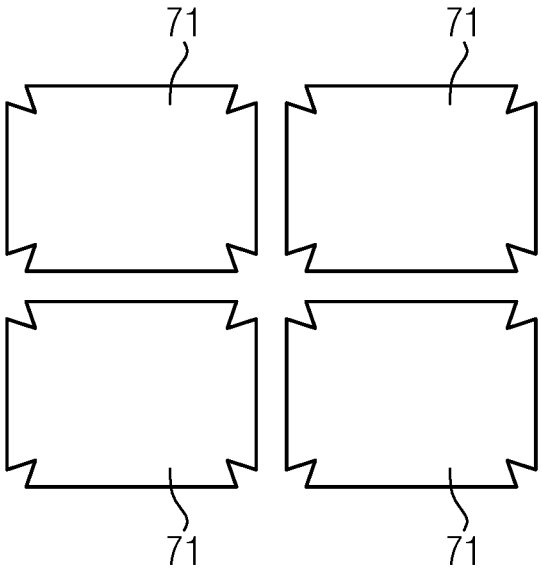
FIG. 5 is a schematic top view of one embodiment of material blanks to be formed into packaging troughs in a method in accordance the present disclosure.

As an alternative, it would also be imaginable to form, instead of the incompletely punched-out sub-areas 21 of the pre-punched material sheet 19, fully punched-out material blanks 71 into packaging troughs 27. FIG. 5 shows exemplarily four such material blanks 71 having a shape of such a nature that packaging troughs 27 of the type shown in FIG. 3 can be formed therefrom.

The material blanks 71 can be positioned on top of the female die part 33 of the forming tool 5 such that each of them covers, at least partially, an opening 37 of a forming cavity 39 of the female die part 33. In order to facilitate the correct positioning of the material blanks 71, the female die part 33 may have provided thereon positioning elements 73, which can be used for orienting the material blanks 71 relative thereto. Such positioning elements 73 are shown in FIG. 4A to 4D by dashed lines as a possible modification. When fully punched-out material blanks 71 are processed, clamping of the material against the contact surface 47 of the female die part 33 can be dispensed with, and the clamping unit 45 of the forming station 5 can therefore be omitted as a modification. As for the rest, a forming station 5 of the above-described kind may be used.

After having been positioned, the respective material blanks 71 are sucked, by means of a vacuum applied by the vacuum unit 55, onto the vertically movable insert 49 provided in the associated forming cavity 39 of the female die part 33. Subsequently, each of the inserts 49 is moved from the starting position along the displacement direction V further into the forming cavity 39. This has the effect that the respective material blank 71 is drawn into the forming cavity 39 and thus formed into a packaging trough 27.

It is also imaginable to position a thermoplastic film layer 41 on top of the material blanks 71 on top of the female die part 33 and, in addition, to optionally form-in the thermoplastic film layer 41 into the packaging troughs 27 through compressed air from the compressed-air unit 61.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method for producing a packaging, the method comprising the steps of:

providing a pre-punched material sheet from which a sub-area has been punched out incompletely such that the sub-area is connected to a residual area of the material sheet through a plurality of retaining lugs;

positioning the pre-punched material sheet on top of a female die part of a forming tool such that the sub-area of the material sheet at least partially covers an opening of a forming cavity of the female die part;

clamping the residual area of the material sheet in position against a contact surface of the female die part;

sucking the sub-area of the material sheet onto an insert within the forming cavity using a vacuum while the insert is at a first position, wherein the insert is vertically movable in the forming cavity of the female die part between the first position and a second position; and moving the insert from the first position in a displacement direction further into the forming cavity toward said second position to draw the sub-area of the material sheet into the forming cavity and form the material sheet into a packaging trough.

2. The method according to claim 1, further comprising the step of tearing the retaining lugs to separate the sub-area from the residual area of the material sheet during the moving the insert from the first position further into the forming cavity toward the second position step.

3. The method according to claim 1, wherein the providing the pre-punched material sheet step comprises the step of pre-punching the material sheet to incompletely punch out the sub-area of the material sheet so that the sub-area remains connected to the residual area of the material sheet through the plurality of retaining lugs.

4. The method according to claim 1, wherein the forming cavity comprises one or more sidewalls that form an incline, wherein the incline widens the forming cavity in a direction from within the forming cavity towards the opening of the forming cavity.

5. The method according to claim 1, wherein the material of the material sheet is essentially not thermoplastically deformable.

6. The method according to claim 1, wherein the material of the material sheet comprises natural fibers, cardboard and/or paper.

7. The method according to claim 1, further comprising the step of positioning a thermoplastic film layer on top of the material sheet that is positioned on top of the female die part.

8. The method according to claim 7, further comprising the step of forming the thermoplastic film layer into the packaging trough by applying compressed air from a side of the thermoplastic film layer opposite the material sheet.

9. The method according to claim 7, further comprising the step of heating the thermoplastic film layer after the positioning the film layer on top of the material sheet step using a heating unit disposed on a side of the film layer opposite the female die part.

10. A forming tool for producing a packaging trough, the forming tool comprising:

a female die part comprising a contact surface and a forming cavity having an opening, wherein the forming cavity of the female die part includes an insert, the insert being vertically movable from a first position in a displacement direction further into the forming cavity to a second position;

a clamping unit, which is configured for clamping a residual area of a material sheet in position against the contact surface of the female die part when the material sheet has been positioned on top of the female die part such that a sub-area of the material sheet at least partially covers the opening of the forming cavity of the female die part, wherein the sub-area of the material sheet is connected to a residual area of the material sheet through a plurality of retaining lugs; and a vacuum unit in fluid communication with the forming cavity and configured for sucking the sub-area of the material sheet onto the insert disposed at the first position using a vacuum.

11. The forming tool according to claim 10, wherein the forming cavity comprises a forming incline that widens in the direction from within the cavity towards the opening of the forming cavity.

12. The forming tool according to claim 10, further comprising a compressed-air unit disposed to apply compressed air on a thermoplastic film layer in the direction towards the material sheet when the thermoplastic film layer is positioned on top of the material sheet when the material sheet is positioned on top of the female die part, the compressed air being appliable to a side of the thermoplastic film layer opposite the material sheet.

13. The forming tool according to claim 12, further comprising a heating unit for heating the thermoplastic film layer when the thermoplastic film layer has been positioned on top of the material sheet on top of the female die part, the heating unit being disposed on the side of the film layer opposite the female die part.

14. The forming tool according to claim 13, wherein the heating unit is movable towards and away from the female die part in a direction parallel to the displacement direction of the insert.

15. A packaging machine, comprising:

the forming tool for producing a packaging from the material sheet according to claim 10; and a punching station upstream of said forming tool, the punching station configured for pre-punching the material sheet by incompletely punching out the sub-area of the material sheet so that the sub-area remains connected to the residual area of the material sheet through the plurality of retaining lugs.

16. The packaging machine according to claim 15, further comprising a conveying unit downstream of the punching station, wherein the conveying unit is operable to position the material sheet that has been pre-punched by the punching station on top of the female die part of the forming tool such that the sub-area of the material sheet at least partially covers the opening of the forming cavity of the female die part.

* * * * *